US005467180A

United States Patent [19]

Malachowski et al.

[11] Patent Number: 5,467,180

[45] Date of Patent: Nov. 14, 1995

[54] HIGH AIR FLOW LOW PRESSURE PREFUSER TRANSPORT

[75] Inventors: Michael Malachowski, Webster, N.Y.; Charles W. Spehrley, Jr., White River Junction, Vt.; Dean Thomas, Webster; Michelle Remus, Rochester, both of N.Y.; Robert R. Schaffer, Canaan, N.H.

[73] Assignee: Xerox Corporation, Stamford, Conn.

[21] Appl. No.: 327,721

[22] Filed: Oct. 20, 1994

[51] Int. Cl.[6] ..... G03G 21/00

[52] U.S. Cl. ..... 355/312; 271/197; 271/276

[58] Field of Search ..... 355/208, 271, 355/273, 282, 312, 315; 219/216; 271/194–197, 276

[56] References Cited

U.S. PATENT DOCUMENTS

| | | | |
|---|---|---|---|
| 3,743,403 | 7/1973 | Sanza | 355/312 |
| 3,774,907 | 11/1973 | Borostyan | 355/312 X |
| 3,794,417 | 2/1974 | Machmer | 355/312 X |
| 4,017,065 | 4/1977 | Poehlein | 271/80 |
| 4,110,027 | 8/1978 | Sato et al. | 355/312 X |
| 4,286,863 | 9/1981 | Cornwall et al. | 355/312 X |
| 4,417,800 | 11/1983 | Hirose et al. | 355/312 X |
| 4,794,429 | 12/1988 | Acquaviva | 271/197 X |
| 4,905,052 | 2/1990 | Cassano et al. | 355/312 |
| 5,031,002 | 7/1991 | Yaguchi | 355/312 |
| 5,063,415 | 11/1991 | Ariyama | 355/312 |
| 5,166,735 | 11/1992 | Malachowski | 355/282 |
| 5,294,965 | 3/1994 | May | 355/312 |

*Primary Examiner*—Robert Beatty

*Attorney, Agent, or Firm*—H. Fleisher; J. E. Beck; R. Zibelli

[57] ABSTRACT

An apparatus for advancing a sheet from a moving imaging member having an unfused image after transfer of the image to the sheet. After the image is transferred to the sheet, the sheet is advanced by a transport to a fuser. The transport has low impedance, high air flow to draw the sheet toward the transport for acquisition. As the sheet is moved across the transport, an increased air flow impedance causes a low vacuum pressure in the transport to provide a low drive force that minimizes quality and motion disturbances on the sheet. The low drive force exerted on the sleet is lower than a holding force of the sheet to the moving imaging member thus causing the sheet to slide on the transport.

14 Claims, 4 Drawing Sheets

HIGH AIR FLOW LOW PRESSURE PREFUSER TRANSPORT

The present invention relates generally to a sheet transport system in an electrophotographic printing machine, and more particularly concerns a sheet transport system.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms a powder image on the photoconductive member.

In the foregoing type of printing machine, the powder image formed on the photoconductive member is transferred from the photoconductive member to a copy sheet. The transferred powder image is typically only loosely applied to the copy sheet whereby, it is easily disturbed by the process of stripping the copy sheet from the photoconductive member and by the process of transporting the copy sheet to a fusing station. The copy sheet preferably passes through a fusing station as soon as possible after transfer to fuse the powder image permanently onto the copy sheet. Fusing permanently fixes the powder image to the sheet. One type of suitable fusing station is a roll-type fuser, wherein the copy sheet is passed through a pressure nip existing between two rolls, at least one of which is heated.

A prefuser transport receives the copy sheet with the unfused image thereon from the photoconductive member and moves it to the fuser rolls. Prefuser transports may use a blower as an air moving device. In the presence of an impedance, the blower is a low flow, high pressure device. With low impedance, air flow through an open port is sufficient for sheet acquisition. However, a low sheet vacuum is required to limit the drive force on the sheet. When the impedance to the air flow increases by sheets progressively covering plenum ports, the resulting increase in pressure makes it difficult to maintain a low vacuum. An approach previously taken to overcome this problem uses a valving mechanism which, with gravity loading, responds to the increase in pressure to passively open other ports in order to maintain constant pressure and constant drive. Another approach uses a solenoid actuated valve to balance vacuum pressure. Both of these approaches require costly components and can be unreliable. Clearly, it would be desirable to have a prefuser transport incorporating an air moving device for maintaining high air flow for sheet acquisition and a low vacuum for motion quality without the use of expensive mechanical valving techniques.

The following disclosures appear to contain relevant subject matter:

U.S. Pat. No. 4,017,065
Patentee: Poehlein
Issued: Ap. 12, 1977
U.S. Pat. No. 5,166,735
Patentee: Malachowski
Issued: Nov. 24, 1992
U.S. patent application Ser. No. 08/279609
Applicant: Malachowski
Filed: Jul. 25, 1994

The disclosures of the above-identified patents may be briefly summarized as follows:

U.S. Pat. No. 4,017,065 describes a vacuum transport for moving a copy sheet from an image transfer area to a fuser roll nip. In operation, the transport forms a buckle in the intermediate portion of the copy sheet to compensate for a speed mismatch between the fuser roll nip and the initial image support surface. A manifold having two separate plenum chambers controls the buckle by cyclic reductions in the vacuum applied to the plenum closest to the fuser roll nip. The removal of vacuum from the chamber is accomplished by an electrically operated valve that opens a vent in the manifold top cover to an outside atmosphere.

U.S. Pat. No. 5,166,735 discloses a sheet transport incorporating a control for matching drive speeds imparted to a copy sheet extended between a fuser roll nip and an image transfer area. The transport contains a vacuum plenum which communicates with a receiving surface on the transport. The copy sheet is engaged by the transport and is adhered to the receiving surface by the vacuum. The fuser rolls are driven at a slightly higher speed to tension the copy sheet and lift it from the transport surface. The lifting is detected by a sensor that senses the vacuum in the plenum and accordingly adjusts the drive speed of the fuser rolls.

U.S. patent application Ser. No. 08/279,609 discloses a printing machine in which a copy sheet receives a developed image from a photoconductive member exerting a holding force on the sheet to move the sheet therewith. A transport is positioned to receive the sheet leading edge as the sheet leaves the photoconductive member. The transport exerts a drive force on the sheet in the same direction as the holding force exerted on the sheet by the photoconductive member. A controller, in communication with the transport, regulates the drive force so as to maintain the drive force less than the holding force while also maintaining the sheet in tension and causing the sheet to slip on the transport until the sheet trailing edge leaves the photoconductive member.

Pursuant to the features of the present invention, there is provided an apparatus for advancing a sheet from a moving surface exerting a holding force thereon. A transport is included and positioned to receive the sheet leading edge. The transport exerts a drive force on the sheet in the opposite direction as the holding force exerted on the sheet by the surface. A means for moving air communicates with the transport to generate a high flow for sheet acquisition at a low pressure to maintain the drive force less than the holding force while maintaining the sheet in tension.

In accordance with another aspect of the present invention, there is provided a printing machine of the type in which a sheet receives a developed image from a moving surface exerting a holding force thereon, wherein the improvement includes: a transport positioned to receive the sheet leading edge as the sheet leaves the surface, wherein the transport exerts a drive force on the sheet in the opposite direction as the holding force exerted on the sheet by the surface; and an air moving means in communication with the transport to generate a high air flow for sheet acquisition at a low pressure to maintain the drive force less than the holding force while maintaining the sheet in tension.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
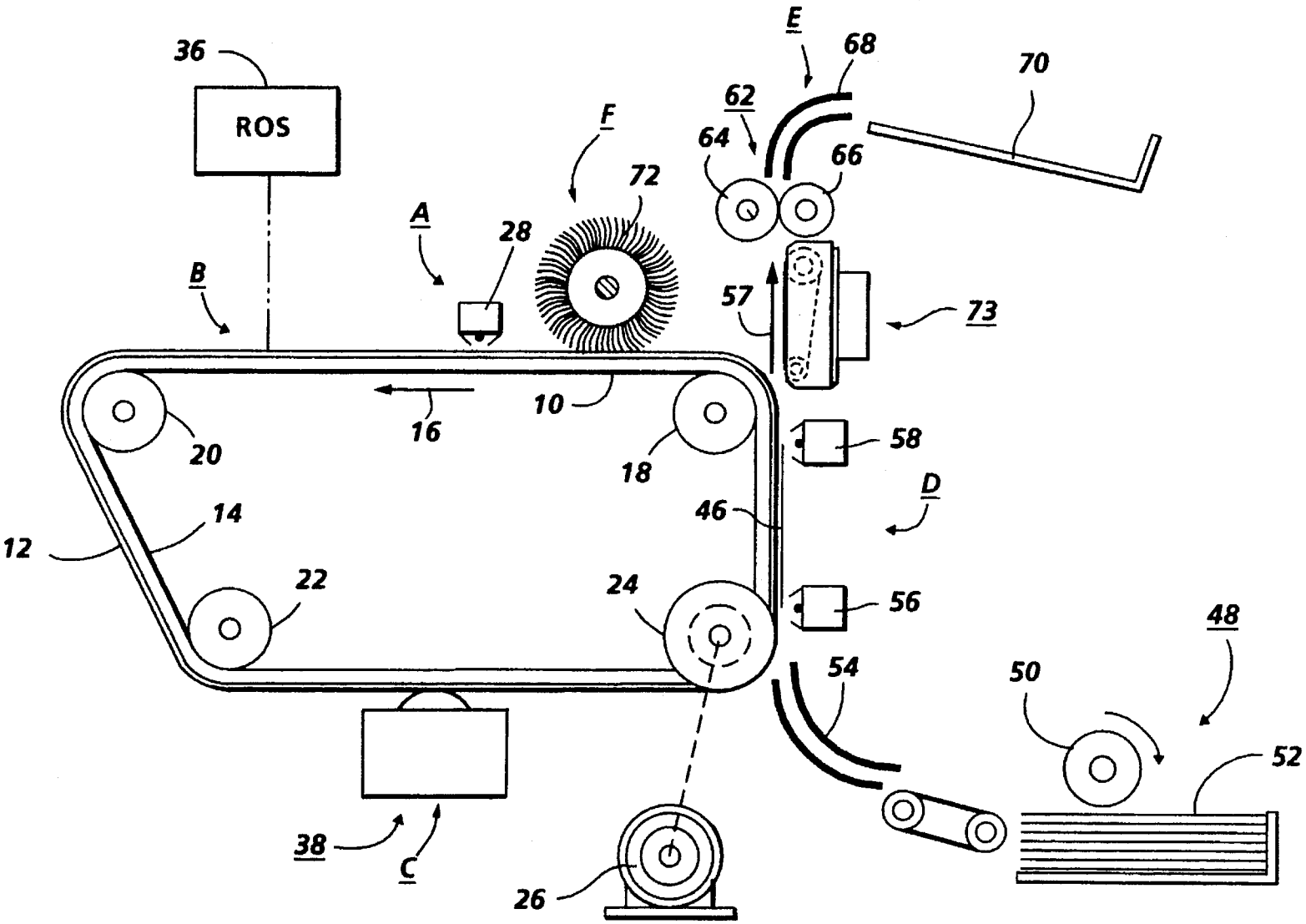
FIG. 1 is a schematic, elevational view depicting an illustrative printing machine.

For a general understanding of the features of the present invention, reference is made to the drawings. In the drawings, like reference numerals have been used throughout to designate identical elements. FIG. 1 schematically depicts the various elements of an illustrative printing machine incorporating the prefuser sheet transport of the present invention therein. It will become evident from the following discussion that the sheet transport is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter and their operation described briefly with reference thereto.

Turning to FIG. 1, the printing machine employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22, 24. Roller 24 is coupled to motor 26 which drives roller 24 so as to advance belt 10 in the direction of arrow 16. The drive system comprising motor 26 is designed to drive the photoconductive belt 10 at a constant velocity.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, a Raster Input Scanner (RIS) and a Raster Output Scanner (ROS) are used instead of a light lens system. The RIS (not shown), contains document illumination lamps, optics, a mechanical scanning mechanism and photosensing elements such as charged couple device (CCD) arrays. The RIS captures the entire image from the original document and converts it to a series of raster scan lines. These raster scan lines are the output from the RIS and function as the input to a ROS 36 which performs the function of creating the output copy of the image and lays out the image in a series of horizontal lines with each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36. ROS 36 is controlled by the output from an electronic subsystem (ESS) which prepares and manages the image data flow between a computer and ROS 36. The ESS (not shown) is the control electronics for the ROS 36 and may be a self-contained, dedicated minicomputer. Thereafter, belt 10 advances the electrostatic latent image recorded on photoconductive surface 12 to development station C One skilled in the art will appreciate that a light lens system may be used instead of the RIS/ROS system heretofore described. An original document may be positioned face down upon a transparent platen. Lamps would flash light rays onto the original document. The light rays reflected from the original document are transmitted through a lens forming a light image thereof. The lens focuses the light image onto the charged portion of photoconductive surface to selectively dissipate the charge thereon. This records an electrostatic latent image on the photoconductive surface which corresponds to the informational areas contained within the original document disposed upon the transparent platen.

At development station C, a magnetic brush developer system, indicated generally by the reference numeral 38, transports developer material comprising carrier granules having toner particles adhering triboelectrically thereto into contact with the electrostatic latent image recorded on photoconductive surface 12. Toner particles are attracted from the carrier granules to the latent image forming a powder image on the photoconductive surface 12 of belt 10. While dry developer material has been described, one skilled in the art will appreciate that a liquid developer material may be used in lieu thereof.

After development, belt 10 advances the toner powder image to an image transfer station D. At transfer station D, a sheet of support material comprising copy sheet 46 is moved into contact with the toner powder image. Copy sheet 46 is advanced to transfer station D by a sheet feeding apparatus, indicated generally by the reference numeral 48. Preferably, sheet feeding apparatus 48 includes a feed roll 50 contacting the uppermost sheet of a stack of sheets 52. Feed roll 50 rotates to advance the uppermost sheet from stack 52 into sheet chute 54. Chute 54 directs the advancing copy sheet 46 into contact with photoconductive surface 12 of belt 10 in a timed sequence so that the toner powder image developed thereon contacts the advancing copy sheet 46 at image transfer station D.

Image transfer station D includes a corona generating device 56 which applies electrostatic transfer charges to the backside of copy sheet 46 and electrostatically tacks copy sheet 46 against the photoconductive surface 12 of belt 10. The electrostatic transfer charges attracts the toner powder image from photoconductive surface 12 to copy sheet 46. After transfer, the lead edge of copy sheet 46 is transported on the photoconductive surface 12 under a detacking corona generator 58 which neutralizes most of the tacking charge thereon. However, it is not desirable to remove all of the transfer charges on the copy sheet 46, since that may reduce the electrostatic retention of the toner image to copy sheet 46. The detack charge, preferably applied with an alternating current corona emission is sufficient enough to allow copy sheet 46 to self strip from the photoconductive surface of belt 10.

After the lead edge of copy sheet is stripped from the photoconductive surface of belt 10, it travels beneath a prefuser transport 73. The prefuser transport 73 receives the copy sheet 46 with the unfused toner image thereon and advances it to Fusing Station E. The copy sheet 46 moves in the direction of arrow 57. Prefuser transport 73 will be described hereinafter in greater detail, with reference to FIGS. 2 through 4.

Fusing station E includes a fuser assembly, indicated generally by the reference numeral 62, which permanently affixes the toner powder image to copy sheet 46. Preferably, fuser assembly 62 includes a heated fuser roll 64 and a back-up roll 66. Sheet 46 passes between fuser roller 64 and back-up roll 66 with the toner powder image contacting fuser roll 64. In this manner, the toner powder image is permanently affixed to copy sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. One skilled in the art will appreciate that other cleaning means may be used such as a blade cleaner. Subsequent to cleaning, a discharge lamp (not shown) floods photoconductive surface 12 with light to dissipate any residual charge remaining thereon prior to the charging thereof for the next successive imaging cycle.

With continued reference to FIG. 1, a drive force is applied to copy sheet 46 as it is acquired by prefuser transport 73. The drive force is a function of the internal pressure of transport 73, the coefficient of friction of the drive belts, the contact area of the transport drive belts, and the contact area of copy sheet 46. If the drive force exceeds the tack force holding copy sheet 46 to photoconductive surface 12, image quality may be adversely affected when copy sheet 46 seperates from photoconductive surface 12. Smears and skips will occur on the unfused toner image being transferred to the trailing edge of copy sheet 46. The difference between the transport drive force and the tack force likewise affects the motion quality of photoconductive surface 12. As the copy sheet 46 seperates from photoconductive surface 12, any transient jolts on sheet 46 are transmitted directly to photoconductive surface 12. This applies a temporary load on the constant velocity drive system of photoconductive belt 10. Since the jolting may occur too quickly for the drive system to overcome by compensation, subsequent images being transferred may also be disturbed. To prevent copy quality and motion quality degradation, the prefuser transport 73 is driven slightly faster than belt 10. This maintains the copy sheet 46 in tension as it advances from the photoconductive surface 12 to the prefuser transport 73. Tensioning requires that the drive force of the prefuser transport 73 be less than the belt 10 holding force. The belt 10 holding force includes the charging parameters of the transfer corona generator 56 and detack corona generator 58, the tack zone area between corona generators 56, and 58, the velocity of copy sheet 46, the geometry of the copy sheet path, and the copy quality requirements.

Figure 2:
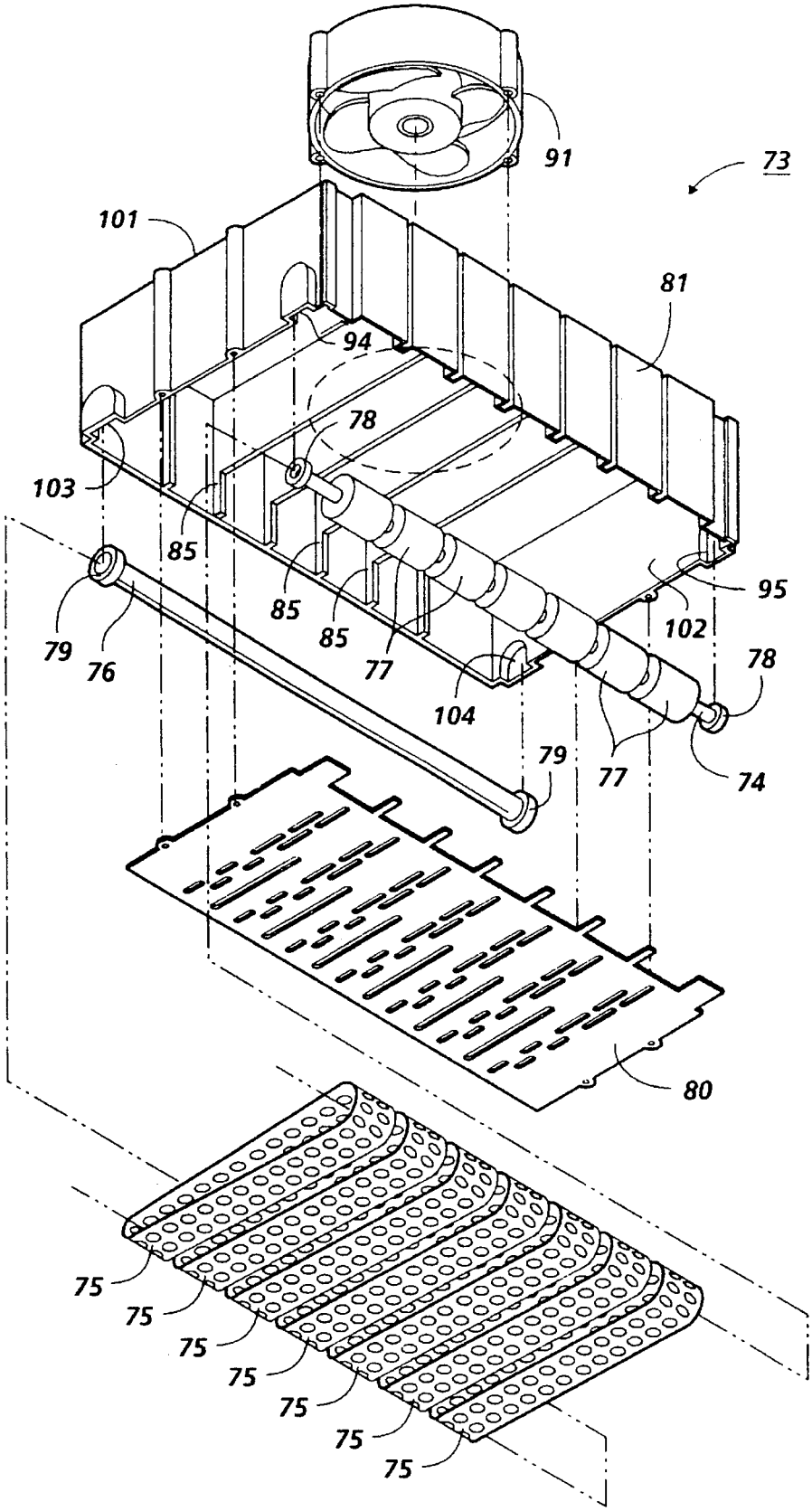
FIG. 2 is a perspective view of a sheet transport used in the FIG. 1 printing machine.

Turning now to FIG. 2, there is shown a perspective view of the prefuser transport 73 used in the FIG. 1 printing machine. The prefuser transport 73 has a sheet receiving surface having a plurality of foraminous belts 75 which are contained within a transport plenum housing cover 81. Belt widths of 1.0 inch, with lands of 0.6 inches are chosen to moderate belt drag over a plenum surface 80, over which plenum housing cover 81 is mounted. The foraminous belts 75 are entrained over a plurality of drive rollers 77 and an idler shaft 76. Drive rollers 77 are fixedly mounted on a drive shaft 74 which is driven by a motor or drive system (not shown). A pair of roller bearings 78 are journaled on opposite ends of the drive shaft 74. The roller bearings 78 engage slots 94 and 95 located respectively on sides 101 and 102 of plenum housing cover 81. Slots 103 and 104 located likewise on sides 101 and 102 of plenum housing cover 81 are engaged by roller bearings 79 which are jounalized on opposite ends of idler shaft 76. An air moving device, such as, Muffin fan 91 located atop plenum housing cover 81 provides an open port air flow in excess of 60 CFM for sheet acquisition. Muffin fan 91 also provides a closed port vacuum pressure of approximately 0.3 inches of water pressure to limit the drive force on the copy sheet to approximately 0.3 pounds of force. A plurality of anti-swirl vanes 85 located inside plenum housing cover 81 prevent the occurrence of whirlwinds that cause a local variation from the average or normal air flow through plenum housing cover 81.

Figure 3:
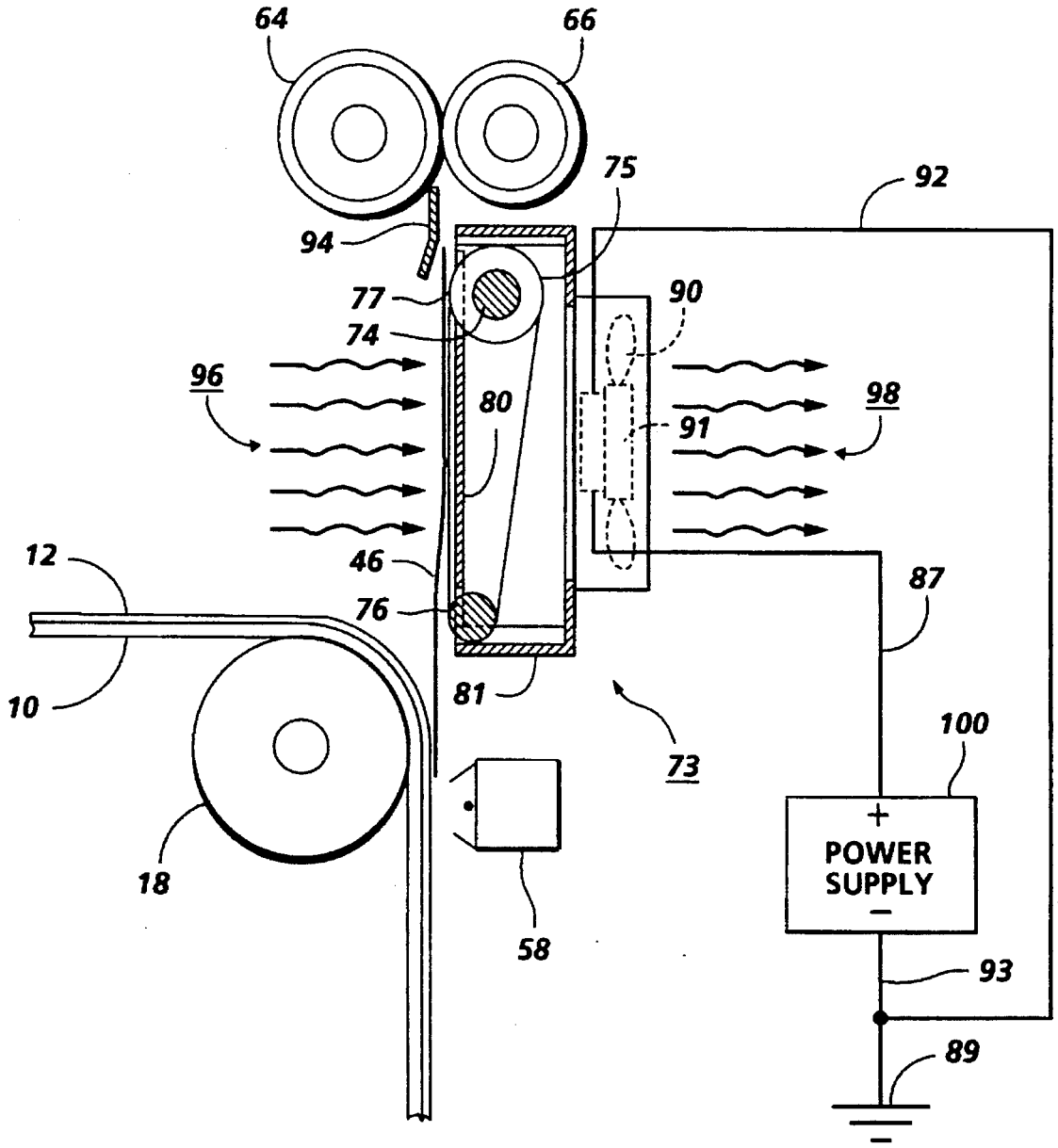
FIG. 3 is a schematic, elevational view showing the FIG. 2 transport.

Referring now to FIG. 3, there is shown a schematic, elevational view of the prefuser transport 73 used in the FIG. 1 printing machine. The prefuser transport 73 is located nominally between 1 and 3 millimeters above the plane of photoconductive belt 10, while the surface of plenum surface 80 is designed to be coplanar with belt 10. The foraminous belts 75 are driven at a velocity approximately 0.85% greater than the velocity of belt 10 to maintain tension on sheet 46 between belt 10 and the prefuser transport 73. Air pressure inside the enclosed space of plenum housing cover 81 is greater than the outside atmosphere. Air is forced into the plenum for distribution through it. Fan 91 having rotating blades 90 mounted thereon creates a negative air pressure or vacuum beneath the prefuser transport 73 by drawing in air as generally indicated by arrows 96. Air flow 96 sucks the copy sheet 46 against a plurality of vacuum holes (not shown) in the foraminous belts 75. Air is discharged from the exhaust side of fan 91 as indicated by arrows 98. The fan 91 is connected to a positive terminal on power supply 100 through a lead 87. The negative terminal of power supply 100 is connected to ground 89 via a lead 93. Likewise, the return side of fan 91 is connected to ground 89 through a lead 92 to complete an electrical circuit that energizes fan 91.

With continued reference to FIG. 3, the lead edge of copy sheet 46 passes under the detack corona generator 58 where the transfer charge is neutralized. This allows copy sheet 46 to self strip from the photoconductive surface 12 of belt 10. The lead edge of copy sheet 46 becomes airborne and seperates from belt 10 to be acquired by prefuser transport 73. As the lead edge of sheet 46 contacts transport 73, air is drawn by fan 91 with minimum impedance, through ports (not shown) in plenum surface 80. The open ports enable a high air flow for acquisition close to photoconductive belt 10. Air drawn through the transport is discharged from the exhaust side of fan 91. Sheet 46 moves onto transport 73 closing the ports on plenum surface 80. The closed ports impede the air flow, thereby causing a low pressure vacuum within plenum housing cover 81. The vacuum sucks copy sheet 46 up against prefuser transport 73 where it adheres to the holes in belts 75. Copy sheet 46 is gripped onto transport 73 and in turn is advanced by the foraminous belts 75. The drive force acting upon copy sheet 46 is a function of the internal vacuum pressure of transport 73, the contact area between sheet 46 and belts 75, and the coefficient of friction of belts 75 which is equal to about 1. Transport 73 moves at a slightly faster velocity than the velocity of photoconductive belt 10. This maintains sheet 46 in tension to prevent copy quality disturbances. Fan 91 continually runs to maintain the drive force exerted on sheet 46 less than the holding force of photoconductive belt 10. With the drive force exerted on sheet 46 by belts 75 of transport 73 being lower than the photoconductive belt 10 holding force, copy sheet 46 slips on belts 75 until its trail edge breaks free from the photoconductive belt 10. Copy sheet 46 is moved by transport 73 to guide 94 which guides the leading edge of the sheet into the nip formed by fuser roll 64 and pressure roll 66.

Figure 4:
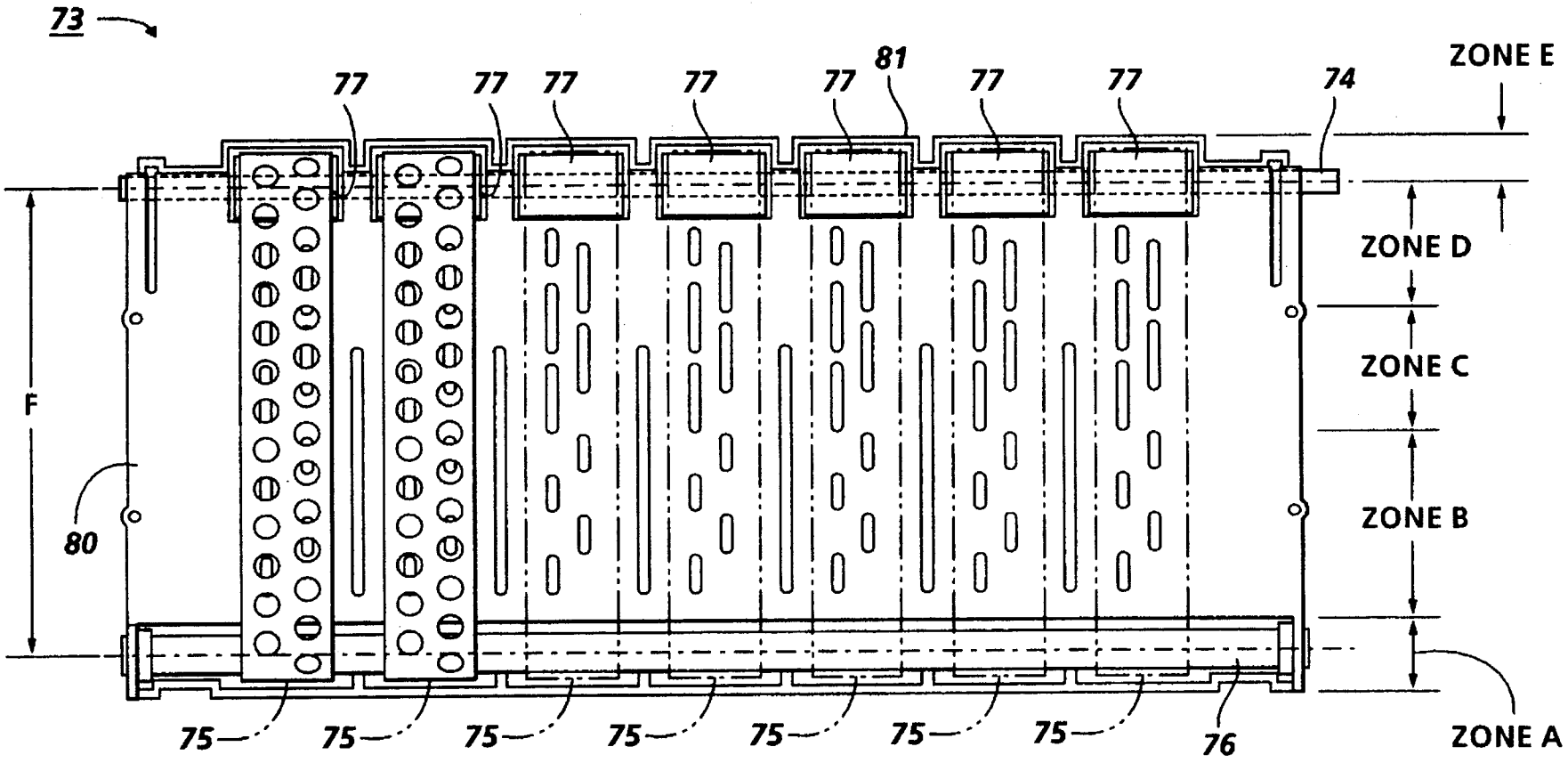
FIG. 4 is a plan, view showing the distribution of vacuum zones in the FIG. 2 sheet transport.

Referring now to FIG. 4, there is shown a distribution of the vacuum zones on plenum surface 80. The vacuum area of plenum surface 80 has a length of approximately 5 inches indicated by dimension F and a width equal to the copy sheet width. Rows of holes and slots constitute a plurality of ports. There is more port area towards the center of plenum surface 80 than at the edges. This assists with the acquisition and movement of smaller sheets. Plenum surface 80 is sectioned into a plurality of vacuum zones generally indicated as: Zone A; Zone B; Zone C; Zone D; and Zone E. Zone A is an input zone enabling high flows to acquire the copy sheet from the photoconductive belt. The open area is approximately 1.8 square inches. Zone B is a first transport zone that maintains acquisition of the sheet and reduces drive force by supporting the sheet between the foraminous belts 75 and plenum surface 80. Its open area is approximately 2.3 square inches. Zone C is a move zone that provides enough force to push the copy sheet into the fuser. The open area of Zone C is approximately equal to 2.5 square inches. Zone D is a second transport zone for maintaining acquisition. Air flow comes from the Zone C ports between the foraminous belts 75 and through the channel formed by the thickness of belts 75. The open area is equal to approximately 0.8 square inches. Zone E is a support that supports the copy sheet after release from transport 73 and plenum surface 80 around foraminous belts 75. Its open area is approximately 1.0 square inches.

In recapitulation, it is clear that the apparatus of the present invention includes a high air flow in the prefuser transport for acquiring a copy sheet and a low vacuum pressure to maintain the drive force exerted on the sheet by the prefuser transport less than the holding force exerted thereon by the photoconductive belt.

It is, therefore, evident that there has been provided, in accordance with the present invention, a sheet transport system that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations as are within the broad scope and spirit of the appended claims.

We claim:

1. An apparatus for advancing a sheet from a moving surface exerting a holding force thereon, including:

a transport, positioned to receive the sheet leading edge, exerting a drive force on the sheet, said transport moving at a greater velocity than the surface so that the sheet slips on said transport until the sheet is separated from the surface, said transport includes a plenum surface, a housing cover mounted over said plenum surface, an input drive member rotatably mounted to said housing cover, an output drive member, spaced from said input drive member, rotatably mounted to said housing cover, a plurality of moving belts entrained about said input drive member, said plenum surface and said output drive member, a plurality of vanes mounted interiorly of said housing to prevent variations in normal air flow through said housing, and means for holding the sheet against said belt with a low pressure; and air moving means, in communication with said transport, to generate a high flow for sheet acquisition at a low pressure to maintain the drive force less than the holding force while maintaining the sheet in tension.

2. An apparatus according to claim 1, wherein said input drive includes:

a drive shaft; and a plurality of drive rollers mounted on said drive shaft so that one of said drive rollers corresponds to one of said belts.

3. An apparatus according to claim 1, wherein said output drive member includes an idler shaft.

4. An apparatus according to claim 1, wherein said plurality of moving belts are coplanar with said plenum surface.

5. An apparatus according to claim 4, wherein the transport drive force is reduced by supporting the sheet on said plenum surface between said belts.

6. An apparatus according to claim 5, wherein:

said plenum surface defines a plurality of apertures therein;

said belts define a plurality of apertures therein; and said holding means includes a blower to form an air flow through the apertures in said plenum surface and said belts to hold the sheet thereagainst.

7. An apparatus according to claim 6, wherein said plenum surface includes:

an input zone having apertures therein enabling high air flows for acquiring the sheet from said moving surface;

a first transport zone having apertures therein for maintaining acquisition of the sheet and reducing the drive force in the sheet by supporting the sheet between said belts and said plenum;

a move zone having apertures therein for providing a force to move the sheet across said transport;

a second transport zone having apertures therein for maintaining acquisition of the sheet; and a support zone for supporting the sheet after release from said transport.

8. A printing machine of the type in which a sheet receives a developed image from a moving surface exerting a holding force thereon, wherein the improvement includes;

a transport, positioned to receive the sheet leading edge, exerting a drive force on the sheet, said transport moving at a greater velocity than the surface so that the sheet slips on said transport until the sheet is separated from the surface, said transport includes a plenum surface, a housing cover mounted over said plenum surface, an input drive member rotatably mounted to said housing cover, an output drive member, spaced from said input member, rotatably mounted to said housing cover, a plurality of moving belts entrained about said input drive member, said plenum surface and said output drive member, a plurality of vanes mounted interiorly of said housing to prevent variations in normal air flow through said housing, and means for holding the sheet against said belt with a low pressure; and air moving means, in communication with said transport, to generate a high flow for sheet acquisition at a low pressure to maintain the drive force less than the holding force while maintaining the sheet in tension.

9. A printing machine according to claim 8, wherein said input drive includes:

a drive shaft; and a plurality of drive rollers mounted on said drive shaft so that one of said drive rollers corresponds to one of said belts.

10. A printing machine according to claim 8, wherein said output drive members include an idler shaft.

11. A printing machine according to claim 8, wherein said plurality of moving belts are coplanar with said plenum surface.

12. A printing machine according to claim 11, wherein the transport drive force is reduced by supporting the sheet on said plenum surface between said belts.

13. A printing machine according to claim 12, wherein:

said plenum surface defines a plurality of apertures therein;

said belts define a plurality of apertures therein; and said holding means includes a blower to form an air flow through the apertures in said plenum surface and said belts to hold the sheet thereagainst.

14. A printing machine according to claim 13, wherein plenum surface includes:

an input zone having apertures therein enabling high air flows for acquiring the sheet from said moving surface;

a first transport zone having apertures therein for maintaining acquisition of the sheet and reducing the drive force in the sheet by supporting the sheet between said belts and said plenum;

a move zone having apertures therein for providing a force to move the sheet across said transport;

a second transport zone having apertures therein for maintaining acquisition of the sheet; and a seal zone for supporting the, sheet after release from said transport.

* * * * *